US006429842B1

(12) United States Patent
Shin et al.

(10) Patent No.: US 6,429,842 B1
(45) Date of Patent: Aug. 6, 2002

(54) LIQUID CRYSTAL DISPLAY

(75) Inventors: Jae Hak Shin, Kyoungki-do; Keun Soo Lee, Seoul, both of (KR)

(73) Assignee: Hyundai Display Technology Inc., Kyoungki-do (KR)

( * ) Notice: Subject to any disclaimer, the term of this patent is extended or adjusted under 35 U.S.C. 154(b) by 0 days.

(21) Appl. No.: 09/296,146

(22) Filed: Apr. 21, 1999

(30) Foreign Application Priority Data

Apr. 22, 1998 (KR) ..... 98-14372

(51) Int. Cl.[7] ..... G09G 3/36

(52) U.S. Cl. ..... 345/92; 345/96; 345/87; 345/100

(58) Field of Search ..... 345/92, 96, 100, 345/87, 97, 205, 206; 359/54, 57; 340/805, 784

(56) References Cited

U.S. PATENT DOCUMENTS

| | | | | |
|---|---|---|---|---|
| 4,639,720 A | | 1/1987 | Rympalski et al. | 340/712 |
| 4,651,148 A | * | 3/1987 | Takeda et al. | 340/805 |
| 5,151,689 A | * | 9/1992 | Kabuto et al. | 340/784 |
| 5,159,476 A | * | 10/1992 | Hayashi | 359/54 |
| 5,253,091 A | * | 10/1993 | Kimura et al. | 345/87 |
| 5,453,857 A | * | 9/1995 | Takahara | 359/57 |
| 5,526,014 A | | 6/1996 | Shiba et al. | 345/96 |
| 5,581,318 A | | 12/1996 | Shiratori | 396/296 |
| 5,648,793 A | * | 7/1997 | Chen | 345/96 |
| 5,691,788 A | | 11/1997 | Kim | 349/96 |
| 5,739,805 A | | 4/1998 | Dingwall | 345/100 |
| 5,959,599 A | * | 9/1999 | Hirakata | 345/92 |
| 6,040,813 A | * | 3/2000 | Takubo | 345/92 |

FOREIGN PATENT DOCUMENTS

JP 06242448 9/1994

* cited by examiner

*Primary Examiner*—Dennis-Doon Chow
*Assistant Examiner*—Alecia Nelson
(74) *Attorney, Agent, or Firm*—Ladas & Parry

(57) ABSTRACT

A TFT-LCD comprising: a plurality of data lines being spaced with each other; a plurality of gate lines being spaced with each other and being crossed with the gate lines; and a plurality of TFTs; wherein TFTs of the plurality of TFTs which are connected to odd data lines of the plurality of data lines, are disposed in the upside of the gate lines and the TFTs of the plurality of TFTs which are connected to the even data lines of the plurality of data lines, are disposed on the downside of the gate lines, thereby being disposed with a zig-zag form; and wherein data signals having different polarities are respectively applied to the data lines corresponding to the odd gate lines of the plurality of gate lines and to the data lines corresponding to the even gate lines of the plurality of gate lines, thereby applying the data signals having different polarities between adjacent two pixels.

5 Claims, 6 Drawing Sheets

FIG.2A (PRIOR ART)

| | D1 | D2 | · · · | Dn−1 | Dn | |
|---|---|---|---|---|---|---|
| G1 | + | + | + | + | + | |
| G2 | + | + | + | + | + | |
| · | + | + | + | + | + | |
| · | + | + | + | + | + | |
| Gm−1 | + | + | + | + | + | |
| Gm | + | + | + | + | + | |

FIG.2B (PRIOR ART)

| | D1 | D2 | · · · | Dn−1 | Dn | |
|---|---|---|---|---|---|---|
| G1 | − | − | − | − | − | − |
| G2 | − | − | − | − | − | − |
| · | − | − | − | − | − | − |
| · | − | − | − | − | − | − |
| Gm−1 | − | − | − | − | − | − |
| Gm | − | − | − | − | − | − |

FIG.3

(PRIOR ART)

| | D1 | D2 | · · · | Dn−1 | Dn |
|---|---|---|---|---|---|
| G1 | + | + | + | + | + |
| G2 | − | − | − | − | − |
| · | + | + | + | + | + |
| · | | | | | |
| · | − | − | − | − | − |
| Gm−1 | | | | | |
| Gm | + | + | + | + | + |

FIG.4

(PRIOR ART)

| | D1 | D2 | · · · | Dn−1 | Dn |
|---|---|---|---|---|---|
| G1 | + | − | + | − | + |
| G2 | + | − | + | − | + |
| · | + | − | + | − | + |
| · | | | | | |
| · | + | − | + | − | + |
| Gm−1 | | | | | |
| Gm | + | − | + | − | + |

FIG.5

(PRIOR ART)

| | D1 | D2 | · · · | Dn−1 | Dn | |
|---|---|---|---|---|---|---|
| G1 | + | − | + | − | + | − |
| G2 | − | + | − | + | − | + |
| · | + | − | + | − | + | − |
| · | − | + | − | + | − | + |
| Gm−1 | + | − | + | − | + | − |
| Gm | − | + | − | + | − | + |

LIQUID CRYSTAL DISPLAY

BACKGROUND OF THE INVENTION

This invention relates to a liquid crystal display, and more particularly to a thin film transistor(TFT) pixel arrangement embodying a dot inversion driving with a line inversion driving.

Liquid crystal displays (LCDs) is a next-generation display device and an immense market to LCDs is prospected to be made. LCD technology has been developed into TFT-LCDs from TN-LCDs and the display performance of LCDs is improved. A TFT-LCD drives a pixel electrode with a TFT, which has a TFT pixel arrangement as shown in FIG. 1. In the prior TFT-LCD 100, TFTs are disposed at the cross points of data lines D1–Dn and gate lines G1–Gm and are arranged in the upside of the respective gate lines G1–Gm.

So as to prevent deterioration of liquid crystal due to a DC voltage, a data inversion driving method is used to drive the TFT-LCD. The data inversion method for preventing deterioration of LC is a method for driving a LCD by alternatively applying a positive(+) data signal and a negative(−) data signal on the basis of one pixel every fields. There are a field inversion driving method, a line inversion driving method, a column inversion driving method and a dot inversion driving method as the data inversion driving method.

The field inversion driving method is shown in FIG. 2*a* and FIG. 2B. On the basis of one pixel, positive(+) data signals are supplied to pixel electrodes in a first field as shown in FIG. 2*a* and negative(−) data signals are supplied to the pixel electrodes in a second field as shown in FIG. 2*b*. However, the field inversion driving method has a disadvantage that asymmetry between the positive pixel voltage and the negative pixel voltage is caused due to capacitive coupling between a gate and a source/drain of a TFT so a flicker is occurred on the entire picture screen of a LCD.

The line inversion driving method is shown in FIG. 3. Positive(+) data signals and negative(−) data signals are alternatively applied to the pixel electrodes along the gate lines G1–Gm. That is, the polarity of the voltage applied to the pixels of the odd gate lines G1, G3, G5, . . . has the opposite polarity of the voltage applied to the pixels of the even gate lines G2, G2, G6, . . . so that the flicker caused between adjacent two pixels in the column direction is offset. However, the line inversion driving method has a disadvantage that the data signals having the same polarity are applied between adjacent two pixels in the row direction so that horizontal crosstalk remains as usual.

The column inversion driving method is shown in FIG. 4. Positive(+) data signals and negative(−) data signals are alternatively applied to the pixel electrode along the data lines D1–Dn That is, the polarity of the voltage applied to the pixels of the odd data lines D1, D3, D5, . . . has the opposite polarity of the voltage applied to the pixel of the even data lines D2, D4, D6, . . . so that the flicker caused between adjacent two pixels in the row direction is offset. However, the column inversion driving method has a disadvantage that the data signals having the same polarity are applied between adjacent two pixels in the column direction so that vertical crosstalk remains as usual.

The dot inversion driving method is shown in FIG. 5, which is in combination of the line inversion driving method and the column inversion driving method. The voltages having different polarities are provided to adjacent two pixels in the row and column directions, respectively so that the flicker caused between adjacent two pixels in the row and the column directions.

However, the dot inversion driving method prevents the flicker to improve the picture quality of TFT-LCDs but the driver IC for the dot inversion driving has a complicate construction and is difficult to drive and the power consumption is large.

SUMMARY OF THE INVENTION

It is an object of the present invention to provide a TFT pixel arrangement of a TFT-LCD which can embody a dot inversion driving with a line inversion driving by arranging TFTS with a zig-zag type along gate lines.

It is another object of the present invention to provide a TFT pixel arrangement of a TFT-LCD capable of embodying a dot inversion driving without modification of a driving IC.

It is still another object of the present invention to provide a TFT pixel arrangement of a TFT-LCD capable of solving the crosstalk problem in a line inversion driving method to improve the picture quality.

It is an aspect of the present invention to provide a TFT-LCD comprising: a plurality of data lines being spaced with each other; a plurality of gate lines being spaced with each other and being crossed with the gate lines; a plurality of thin film transistors (TFTs); and a plurality of pixel electrodes connected to the plurality of TFTs, respectively; wherein TFTs of the plurality of TFTs which are connected to odd data lines of the plurality of data lines, are disposed in the upside of the gate lines and the TFTs of the plurality of TFTs which are connected to the even data lines of the plurality of data lines, are disposed on the downside of the gate lines, thereby being disposed with a zig-zag form; and wherein when odd gate lines of the plurality of gate lines are driven, the first data signals having the first polarity are provided to the plurality of data lines and when even data lines are driven, the second data signals having the second polarity are provided to the plurality of data lines.

In the preferred embodiment, the first data signals are positive data signals and the second data signals are negative data signals. Otherwise, the first data signals are negative data signals and the second data signals are positive data signals.

In the preferred embodiment, the data signals having different polarities are respectively applied to the data lines corresponding to the odd gate lines of the plurality of gate lines and to the data lines corresponding to the even gate lines of the plurality of gate lines respectively, thereby applying the data signals having different polarities between adjacent two pixels.

BRIEF DESCRIPTION OF DRAWINGS

FIG. 2*a* and FIG. 2*b* are diagrams for illustrating a field inversion driving method in the prior TFT-LCD;

FIG. 3 is a diagrams for illustrating a line inversion driving method in the prior TFT-LCD;

FIG. 4 is a diagrams for illustrating a column inversion driving method in the prior TFT-LCD;

FIG. 5 is a diagrams for illustrating a dot inversion driving method in the prior TFT-LCD;

DETAILED DESCRIPTION OF THE INVENTION

Figure 1:
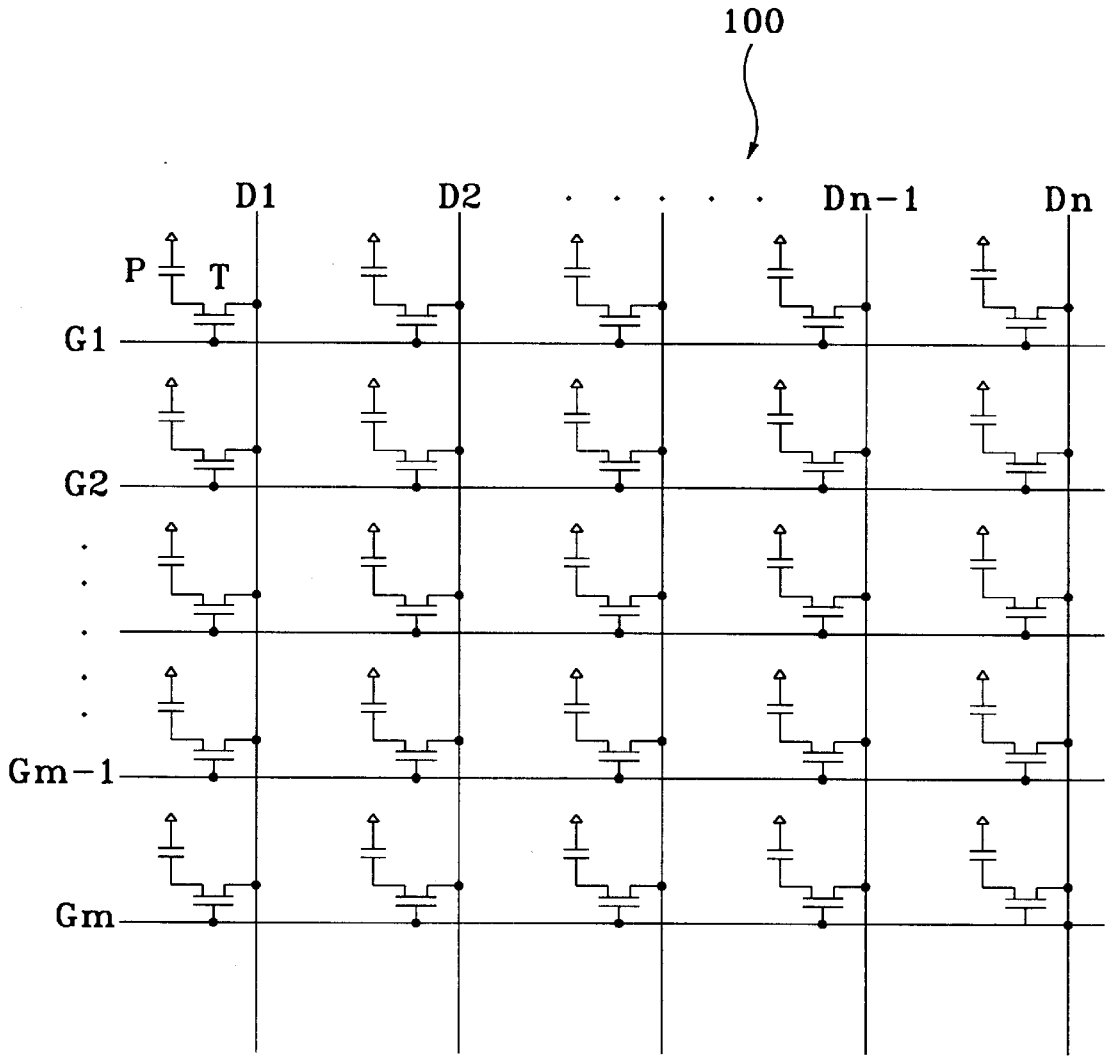
FIG. 1 (PRIOR ART)
FIG. 1 is a diagram for illustrating a TFT pixel arrangement in the prior TFT-LCD.
Figure 6:
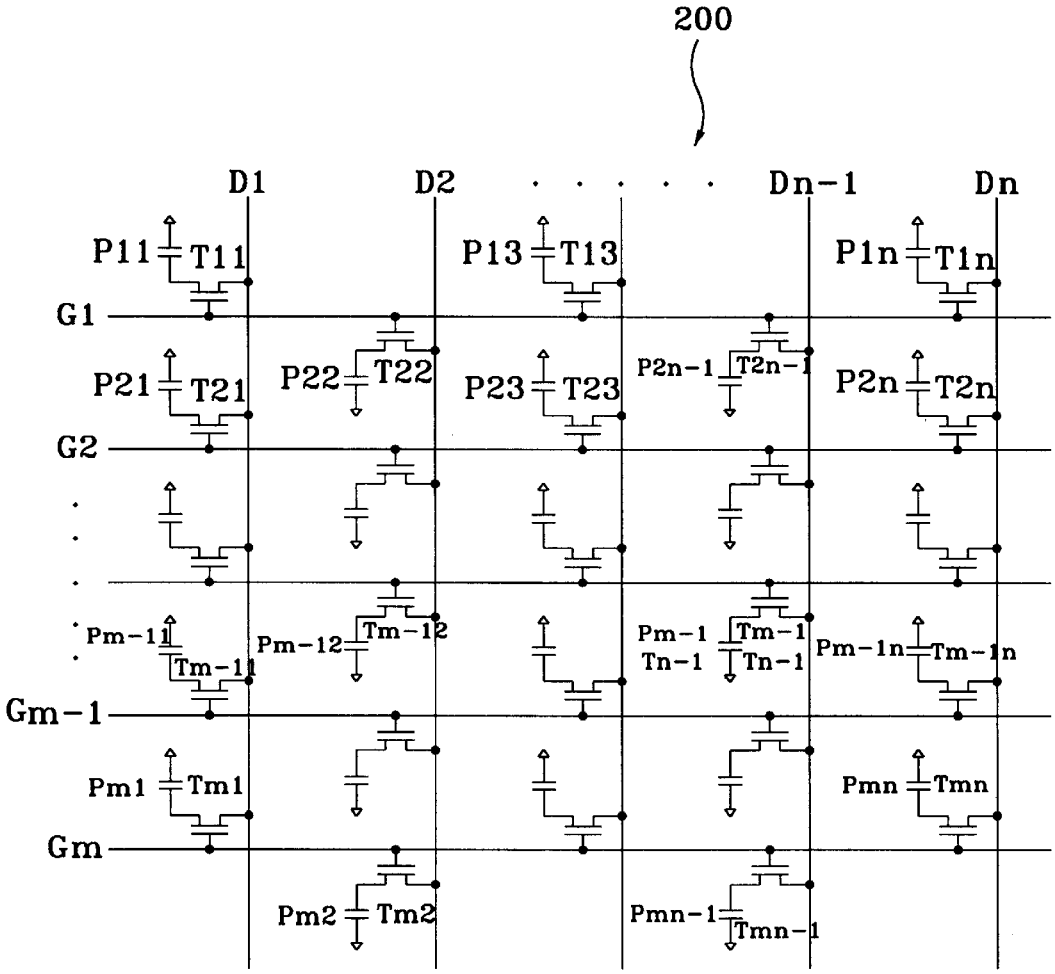
FIG. 6 is a diagram for illustrating a TFT pixel arrangement in accordance with an embodiment of the present invention.

FIG. 6 is a TFT pixel arrangement of a TFT-LCD in accordance with the present invention. In the TFT-LCD 200 of the present invention, a plurality of data lines D1–Dn are formed to be isolated and to be spaced with each other on an insulating substrate such as a glass substrate (not shown in drawings). A plurality of gate lines G1–Gm are formed to be isolated and to be spaced with each other on the insulating substrate. The gate lines G1–Gm and the data lines D1–Dn are crossed with each other. A plurality of TFTs T and a plurality of pixel electrodes P which are connected with each other, are disposed at the intersection points of the gate lines and the data lines. The TFTs T11, T13, T21, T23 . . . of the plurality of TFTs which are connected to the odd data lines D1, . . . , of the plurality of data lines D1–Dn are disposed in the upside of the respective gate lines G1–Gm and the TFTs T22, . . . of the plurality of the TFTs which are connected to the even data lines D2, . . . of the plurality of data lines D1–Dn, are disposed on the downside of the respective gate lines G1–Gm. That is, the TFTs T and the pixel electrodes P are arranged with a zig-zag form along the respective gate lines G1–Gm.

If the TFT-LCD 200 is driven with a line inversion driving method by using a conventional driver IC for a line inversion driving, it is substantially driven with a dot inversion driving method as shown in FIG. 5 in the present invention. Supposed that positive(+) data signals are applied to the data lines D1–Dn along the odd gate lines G1, G3, . . . and then negative(−) data signals are applied to the data lines D1–Dn along the even gate lines G2, G4, . . . in like manner as a line inversion driving method so as to drive the TFT-LCD.

Figure 7A:
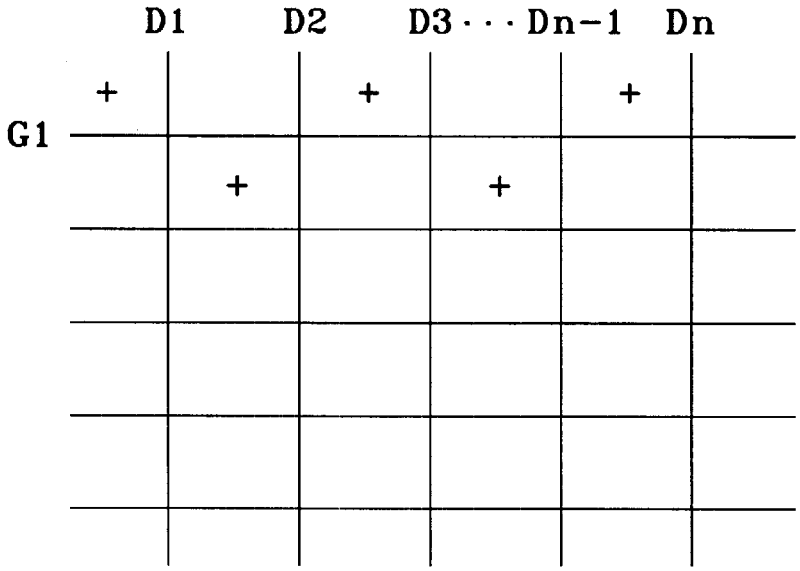
FIG. 7*a* and FIG. 7*b* are diagrams for illustrating a dot inversion driving method of the TFT-LCD with a line inversion driving method in the present invention.
Figure 7B:
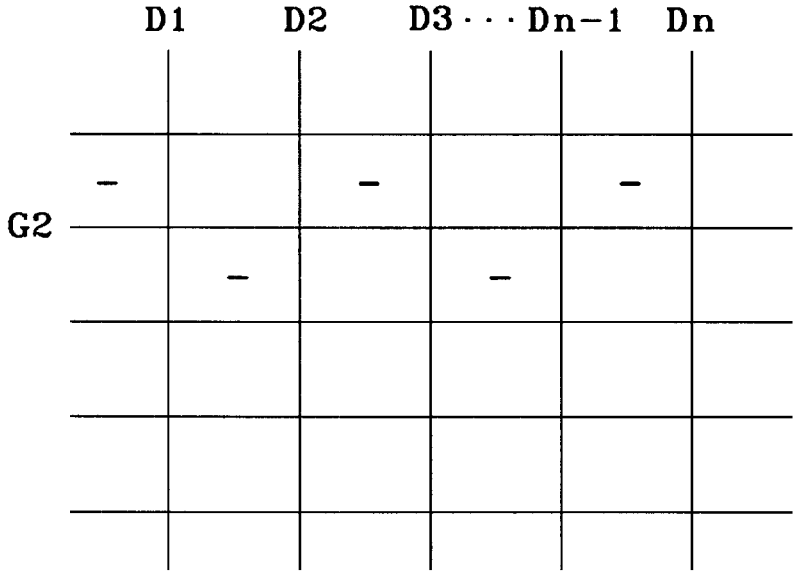

First, the first gate line Gi of the plurality of gate lines G1–Gm is driven by a first scanning signal. Accordingly, the TFTs T1–T1*n* of the plurality of TFTs which are disposed at the crosspoints of the first gate line Gl and the data lines D1–Dn. The positive(+) data signals are provided to the pixel electrodes P11, P13, . . . corresponding to the TFTs T11, T13, . . . of the plurality of TFTs which are disposed in the upside of the gate line G1 and the pixel electrodes P12, P14, . . . corresponding to the TFTs T12, T14, . . . of the plurality of TFTs which are disposed on the downside of the first gate line G1 as shown in FIG. 7*a*. That is, the positive data signals are provided to pixels of the TFT-LCD with a zig-zag form centering around the first gate line G1.

Sequentially, if a second scanning signal is applied to the second gate line G2, the gate line G2 is driven and the TFTs T21–T2*n* of the plurality of TFTs which are arranged at the crosspoints of the gate lines G1–Gm and the data lines D1–Dn. Accordingly, the negative data signals are provided to the pixels P21, P23, . . . corresponding to the TFTs T21, T23, . . . of the plurality of TFTs which are disposed in the upside of the second gate line G2 and the pixels P22, P24, . . . corresponding to the TFTs T22, T24, . . . of the plurality of TFTs which are disposed on the downside of the second gate line G2. That is, the negative data signals are provided to pixels of the TFT-LCD with a zig-zag form centering around the second gate line G2. As above described, the positive and negative data signal are provided to the pixels centering around the first gate line Gi and the second gate line G2, respectively.

Therefore, the positive data signals are provided to the pixels P11–Pm1, P13–Pm3, . . . corresponding to the TFTs T11–Tm1, T13–Tm3 of the plurality of TFTs which are disposed at the crosspoints of the respective gate lines G1–Gm and the data lines D1, D3, . . . of the plurality of data lines D1–Dn. The negative data signals are provided to the pixels P12-Pm2, P14–Pm4, . . . corresponding to the TFTs T12–Tm2, T14–Tm4, . . . of the plurality of TFTs which are disposed at crosspoints of the respective gate lines G1–Gm and the even data lines D2, D4, . . . of the plurality of data lines D1–Dn. The positive and negative data signals are provided to the pixels centering around the gate lines so that. the data signals having different polarities are provided between adjacent two pixels, thereby carrying out a dot inversion driving with a line inversion driving.

According to the present invention, TFT pixels are arranged with a zig-zag form centering around the respective gate lines, thereby being capable of carrying out a dot inversion driving without a conventional driver IC for a line inversion. The dot inversion driving can be embodied with a line inversion driving so that it is capable of simply dot inversion driving the TFT-LCD of the present invention as compared with a conventional dot inversion driving method. Furthermore, because it drives the TFT-LCD with a dot inversion driving by using the conventional line inversion driving method, the present invention can solve the crosstalk.

While the invention has been particularly shown and described with respect to preferred embodiment thereof, it will be understood by those skilled in the art that various changes in form and details may be made therein without departing from the spirit and the scope of the invention as defined by the following claims.

What is claimed is:

1. A thin film transistor-liquid crystal display (TFT-LCD), comprising:

a plurality of data lines being spaced with each other;

a plurality of gate lines being spaced with each other and being crossed with the gate lines;

a plurality of thin film transistors (TFTs) being arranged at the intersection of the plurality of gate lines and data lines; and a plurality of pixel electrodes connected to the plurality of TFTs, respectively;

wherein the plurality of TFTs, which are connected to the intersection of the plurality of gate lines and odd data lines, are disposed in the upside of the plurality of gate lines on the left side of the odd data lines, respectively, and the plurality of TFTs, which are connected to the intersection of the plurality of gate lines and the even data lines, are disposed on the downside of the plurality of gate lines on the left side of the even gate lines, respectively, thereby the plurality of TFTs are disposed along each gate line with a zig-zag form; and when odd gate lines of the plurality of gate lines are driven, the first data signals having a first polarity are provided to the data lines and when even gate lines of the plurality of gate lines are driven, the second data signals are provided to the data lines.

2. The TFT-LCD as claimed in claim 1, wherein the first data signals are positive data signals and the second data signals are negative data signals.

3. The TFT-LCD as claimed in claim 1, wherein the first data signals are negative data signals and the second data signals are positive data signals.

4. The TFT-LCD as claimed in claim 1, wherein data signals having different polarities are respectively applied to the data lines corresponding to the odd gate lines of the plurality of gate lines and to the data lines corresponding to the even gate lines of the plurality of gate lines.

5. The TFT-LCD as claimed in claim 4, wherein th data signals having different polarities are provided between adjacent two pixel electrodes.

* * * * *